US009207595B2

(12) United States Patent
Chosokabe et al.

(10) Patent No.: US 9,207,595 B2
(45) Date of Patent: Dec. 8, 2015

(54) IMAGE FORMING APPARATUS, METHOD OF SETTING FIXING TEMPERATURE, AND COMPUTER PROGRAM PRODUCT

(71) Applicants: Kiriko Chosokabe, Tokyo (JP); Mikio Nakajima, Kanagawa (JP); Homare Ehara, Kanagawa (JP)

(72) Inventors: Kiriko Chosokabe, Tokyo (JP); Mikio Nakajima, Kanagawa (JP); Homare Ehara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/193,496

(22) Filed: Feb. 28, 2014

(65) Prior Publication Data

US 2014/0270836 A1 Sep. 18, 2014

(30) Foreign Application Priority Data

Mar. 15, 2013 (JP) ..... 2013-054343
Oct. 15, 2013 (JP) ..... 2013-214534

(51) Int. Cl.
*G03G 15/20* (2006.01)
*G03G 15/00* (2006.01)

(52) U.S. Cl.
CPC ..... *G03G 15/205* (2013.01); *G03G 15/5016* (2013.01)

(58) Field of Classification Search
USPC ..... 399/38, 42, 67–70
See application file for complete search history.

(56) References Cited

U.S. PATENT DOCUMENTS

| | | | | |
|---|---|---|---|---|
| 5,822,077 | A | 10/1998 | Sasaki et al. | |
| 7,729,629 | B2 | 6/2010 | Takai et al. | |
| 7,792,449 | B2 | 9/2010 | Kurokawa | |
| 7,881,631 | B2 | 2/2011 | Takai et al. | |
| 8,036,559 | B2 | 10/2011 | Takai et al. | |
| 2011/0142469 | A1 | 6/2011 | Nakatsuhara et al. | |
| 2011/0243594 | A1 * | 10/2011 | Saito | 399/70 |

FOREIGN PATENT DOCUMENTS

| | | | |
|---|---|---|---|
| CN | 101038474 | A | 9/2007 |
| CN | 101097433 | A | 1/2008 |
| CN | 102215312 | A | 10/2011 |
| JP | 06-189048 | | 7/1994 |
| JP | 2002-262006 | | 9/2002 |
| JP | 4715381 | | 4/2011 |

OTHER PUBLICATIONS

Office Action for corresponding Chinese application No. 201410177288.X dated Sep. 6, 2015 and English Translation thereof.

* cited by examiner

*Primary Examiner* — Hoan Tran
(74) *Attorney, Agent, or Firm* — Harness, Dickey & Pierce, P.L.C.

(57) ABSTRACT

An image forming apparatus includes: an identification information acquiring unit that acquires identification information to identify a user; a usage history information acquiring unit that acquires usage history information for the user specified by the identification information; an output setting forecasting unit that forecasts output setting used by the user based on the usage history information; and a fixing temperature setting unit that sets a fixing temperature based on the forecasted output setting.

7 Claims, 5 Drawing Sheets

FIG.4

◇FORECAST RESULT (EXAMPLE)

| | PAPER TYPE | PAPER SIZE | COLOR | NUMBER OF SHEETS | POST-PROCESS |
|---|---|---|---|---|---|
| 1 | PLAIN PAPER | A4 | FOUR COLORS | 1 TO 5 SHEETS | YES |
| 2 | PLAIN PAPER | A4 | FOUR COLORS | 6 TO 12 SHEETS | YES |
| 3 | PLAIN PAPER | A4 | FOUR COLORS | 13 TO 50 SHEETS | YES |

◇DETERMINATION OF FIXING TEMPERATURE & WARM-UP DURATION

| FIXING TEMPERATURE | WARM-UP DURATION |
|---|---|
| 155°C | 6 SEC |
| 170°C | 8 SEC |
| 185°C | 9.5 SEC |

IMAGE FORMING APPARATUS, METHOD OF SETTING FIXING TEMPERATURE, AND COMPUTER PROGRAM PRODUCT

CROSS-REFERENCE TO RELATED APPLICATIONS

The present application claims priority to and incorporates by reference the entire contents of Japanese Patent Application No. 2013-054343 filed in Japan on Mar. 15, 2013 and Japanese Patent Application No. 2013-214534 filed in Japan on Oct. 15, 2013.

BACKGROUND OF THE INVENTION

1. Field of the Invention

The present invention relates to an image forming apparatus, a method of setting a fixing temperature, and a computer program product.

2. Description of the Related Art

Most of the recent image forming apparatuses such as copiers have power-saving functions. For example, some copiers maintain a fixing unit at a fixing temperature by applying heat with a heater and fixing toner to a paper sheet. These copiers save electricity by stopping or reducing power supply to the heater during standby without copying to maintain the temperature of the fixing unit at less than the fixing temperature.

Thus maintaining the fixing unit at a low temperature during standby allows power saving. A user, however, needs to wait until the completion of a preparation operation for increasing the temperature of the fixing unit to the fixing temperature even when the user wants to copy urgently, which is inconvenience.

On this account, Japanese Laid-open Patent Publication No. 06-189048 discloses a technique of a copier that detects a person's approach in a power saving mode, determines whether the person is the user of the copier, and then releases the power saving mode when the person is determined as the user. This technique allows the preparation operation to be started before a user reaches the installation site of the copier and reduces the waiting time.

In the technique disclosed in Japanese Laid-open Patent Publication No. 06-189048, power saving is released whenever a user approaches. Because of this, disadvantageous situations occur such that the power saving mode is released even when a user intending to use another device near the copier approaches the copier, leading to unnecessary power supply.

Japanese Laid-open Patent Publication No. 2007-049308 discloses an image forming apparatus dealing with the disadvantages. This image forming apparatus acquires a user identification information (ID) when a user holding an employee ID card to which an integrated circuit (IC) tag storing the user ID is attached approaches, and refers to the past usage history. The image forming apparatus then forecasts the use of an application for an output operation (image forming process) (called an output application, hereinafter) and starts a preparation operation including warming up of the fixing unit. Both Power saving and user convenience can be thus achieved.

In the image forming apparatus disclosed in Japanese Laid-open Patent Publication No. 2007-049308, the fixing temperature of the output application is not optimized (but is fixed) depending on the output setting (the number of sheets, a paper type, a paper thickness, a color mode, etc.). As a result, for example, the small number of output sheets per one action results in unnecessary power consumption due to excessive power supply.

The fixing temperature when the number of output sheets per one action is smaller (6 sheets or smaller, for example) can be set lower to reduce power consumption than when the number of output sheets (50 sheets, for example) is larger. However, the fixing temperature is typically set high in case the number of output sheets per one action is large. In general, in image forming apparatuses placed in offices, the number of output sheets per one action is often small under present circumstances, leading to increase in unnecessary power consumption due to excessive power supply.

In view of the above, there is a need to provides an image forming apparatus, a method of setting a fixing temperature, and a computer program product that enable reduction in unnecessary power consumption due to the setting of high fixing temperature.

SUMMARY OF THE INVENTION

It is an object of the present invention to at least partially solve the problems in the conventional technology.

An image forming apparatus includes: an identification information acquiring unit that acquires identification information to identify a user; a usage history information acquiring unit that acquires usage history information for the user specified by the identification information; an output setting forecasting unit that forecasts output setting used by the user based on the usage history information; and a fixing temperature setting unit that sets a fixing temperature based on the forecasted output setting.

A method sets a fixing temperature of an image forming apparatus. The method includes: acquiring identification information to identify a user; acquiring usage history information for the user specified by the identification information; forecasting output setting used by the user based on the usage history information; and setting a fixing temperature based on the forecasted output setting.

A computer program product includes a non-transitory computer-usable medium having computer-readable program codes embodied in the medium. The program codes when executed cause a computer to execute: acquiring identification information to identify a user; acquiring usage history information for the user specified by the identification information; forecasting output setting used by the user based on the usage history information; and setting a fixing temperature based on the output forecasted setting.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4 is a diagram illustrating an example of the relation between the forecast result of the output setting and the fixing temperature and the warm-up duration in FIG. 3.

DETAILED DESCRIPTION OF THE PREFERRED EMBODIMENTS

Embodiments of the present invention are described with reference to the accompanying drawings.

Schematic Configuration of Image Forming Apparatus

Figure 1:
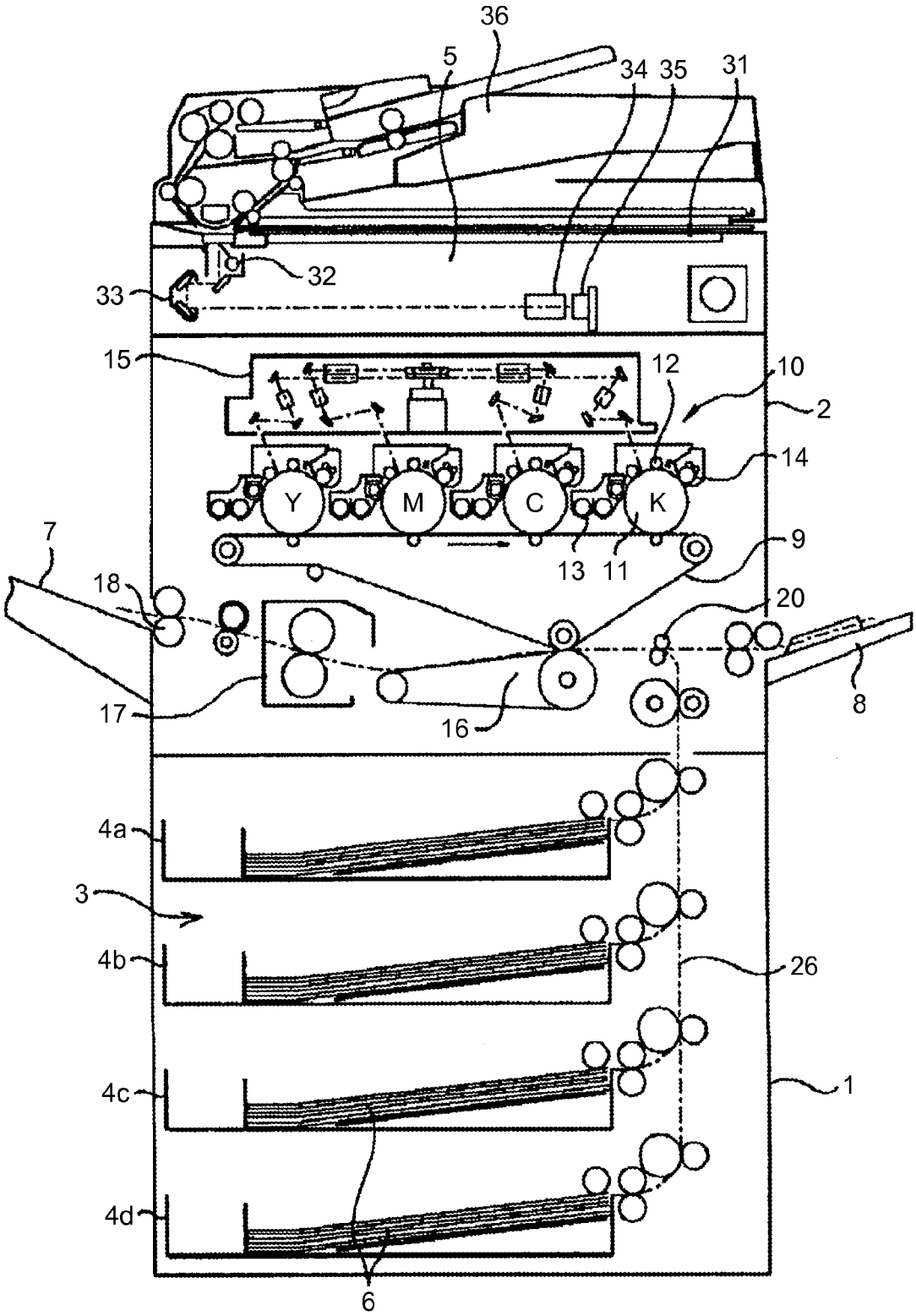
FIG. 1 is a longitudinal front sectional view schematically illustrating the whole configuration of an image forming apparatus according to an embodiment of the present invention.

FIG. 1 is a longitudinal front sectional view schematically illustrating the whole configuration of an image forming apparatus according to an embodiment of the present invention.

The image forming apparatus of the present embodiment is a tandem type full-color image forming apparatus of an electrophotographic system. The image forming apparatus includes an image forming unit (printer engine) 2 at almost the center of an apparatus main body 1 and a paper feeding unit 3 as a paper feeding unit directly below the image forming unit 2.

The paper feeding unit 3 includes four paper feeding cassettes 4*a* to 4*d* each serving as a paper sheet storing unit, for example. These paper feeding cassettes 4*a* to 4*d* are provided to the apparatus main body 1 to be capable of being drawn and housed in the front and back direction (the front and back direction from the paper surface on the drawing). Paper sheets in different sizes (B5, A4, and B4) and different orientations (vertical and horizontal) are set in the paper feeding cassettes 4*a* to 4*d*.

A reading unit (scanner) 5 to read document images is provided above the image forming unit 2. A paper discharge tray 7 onto which a paper sheet 6 subjected to image formation is discharged is provided downstream of the image forming unit 2 in the paper sheet conveying direction (left on the drawing). A manual feeding tray 8 as a paper sheet storing unit for manual feed of the paper sheet 6 is provided upstream of the image forming unit 2 in the paper sheet conveying direction (right on the drawing).

In the image forming unit 2, a plurality of image forming units 10 for yellow (Y), magenta (M), cyan (C), and black (K) are opposed above an intermediate transfer belt 9 of an endless belt. At each of the image forming units 10, electrophotography processing members or devices such as a charging device 12, a developing device 13, and a cleaning device 14 are arranged along the rim of a drum-shaped photosensitive element 11 provided for the corresponding color. An exposing unit 15 is arranged above the image forming units 10 and irradiates the surface of the photosensitive element 11 with laser light according to image information.

The charging device 12 performs charging processing on the surface of the photosensitive element 11. The exposing unit 15 irradiates the charged surface of the photosensitive element 11 with laser light. The developing device 13 visualizes, with toner, an electrostatic latent image formed on the surface of the photosensitive element 11 through exposure with laser light. The cleaning device 14 recovers the toner remaining on the surface of the photosensitive element 11 after transfer.

Image forming process is implemented as follows. An image of each of the colors is formed in turn on the intermediate transfer belt 9, and the four colors are superimposed on the intermediate transfer belt 9 to form one color image. In this process, first, toner in yellow (Y) is subjected to development by an image forming unit of yellow (Y) and is transferred onto the intermediate transfer belt 9. Next, toner in magenta (M) is subjected to development by an image forming unit of magenta (M) and is transferred onto the intermediate transfer belt 9. Toner in cyan (C) is then subjected to development by an image forming unit of cyan (C) and is transferred onto the intermediate transfer belt 9. Finally, toner in black (K) is subjected to development and is transferred onto the intermediate transfer belt 9, thereby forming a full-color toner image in which the four colors are superimposed. The full-color toner image transferred onto the intermediate transfer belt 9 is transferred by a transferring device 16 and is fixed by a fixing unit 17 onto the paper sheet 6 fed from the paper feeding unit 3. The paper sheet 6 is then discharged by paper discharge rollers 18 onto the paper discharge tray 7.

In the reading unit 5, a first traveling body 32 and a second traveling body 33 on which mirrors and a light source for illuminating a document are mounted reciprocate to scan a document (not shown) placed on a contact glass 31.

A lens 34 condenses light reflected from the document scanned by the first traveling body 32 and the second traveling body 33 on the image formed surface of a charge-coupled device (CCD) 35 located at the back of the lens 34. The CCD 35 reads the light as an image signal.

The read image signal is digitized and is subjected to image processing. A laser diode (LD) (not shown) in the exposing unit 15 emits light in response to an image processed signal to perform optical writing on the surface of the photosensitive element 11, thereby forming an electrostatic latent image. The optical signal from the LD reaches the photosensitive element 11 through a known polygon mirror or a known lens.

An automatic document conveying device 36 is mounted above the reading unit 5 and automatically conveys a document onto the contact glass 31.

The image forming apparatus of the present embodiment is a multifunctional image forming apparatus (multifunction peripheral (MFP)) that has besides the function (copy application) as a copier described above, a facsimile function (fax application), a printer function (printer application), and a scanner function (scanner application). Image formation with any of these output applications is performed by forming an image on the paper sheet 6 in the image forming process described above, and the paper sheet 6 is discharged onto the paper discharge tray 7.

Control System Configuration of Image Forming Apparatus

Figure 2:
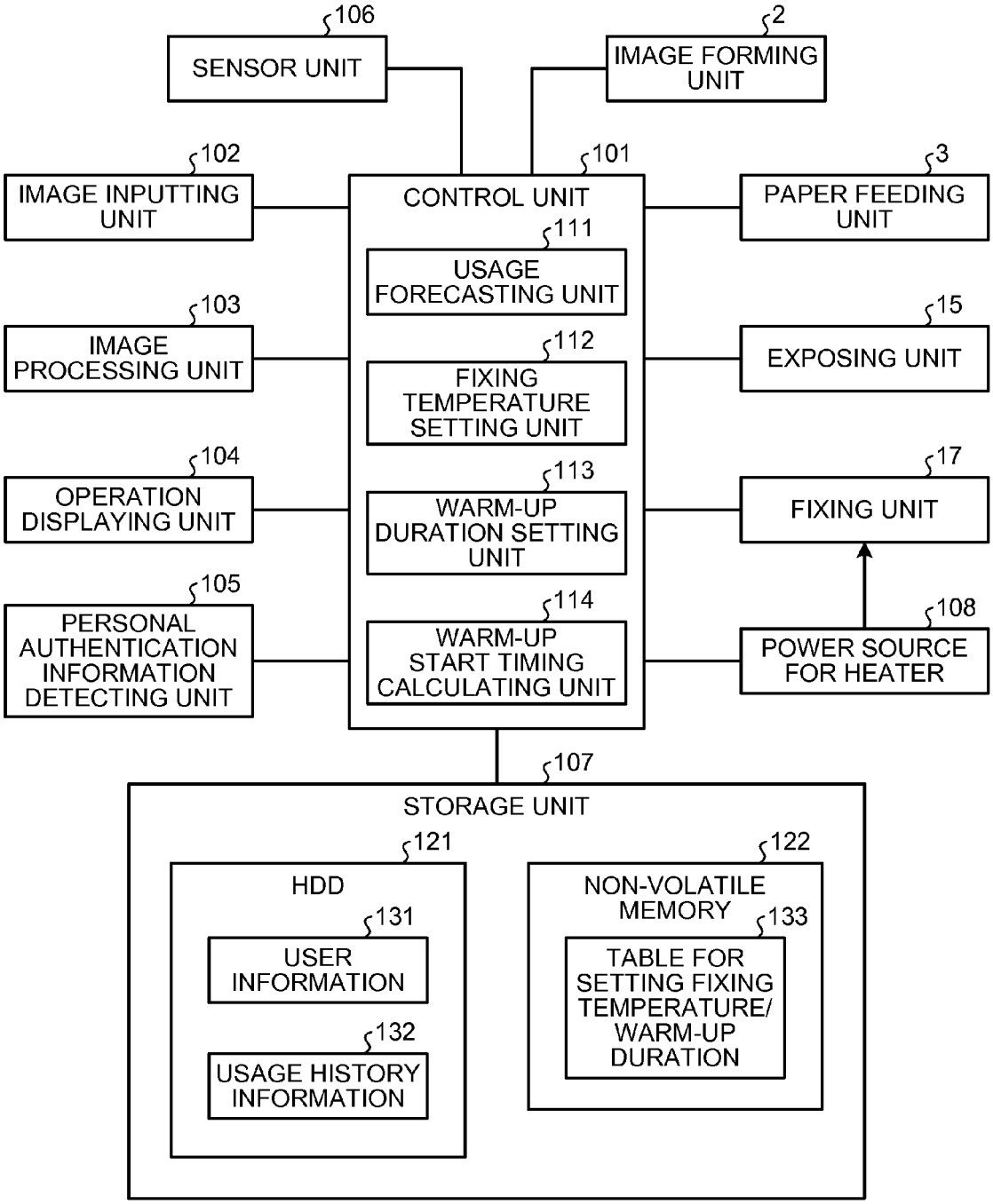
FIG. 2 is a block diagram of the control system configuration of the image forming apparatus of the present embodiment.

FIG. 2 is a block diagram of the control system configuration of the image forming apparatus of the present embodiment.

The control system of the image forming apparatus of the present embodiment includes a control unit 101 as well as an image inputting unit 102, an image processing unit 103, an operation displaying unit (operation panel) 104, a personal authentication information detecting unit 105, a sensor unit 106, the image forming unit 2, the paper feeding unit 3, the exposing unit 15, the fixing unit 17, a storage unit 107, and a power source 108 for a heater, each of which are connected to the control unit 101.

The control unit 101 contains a microcomputer including a central processing unit (CPU), a read only memory (ROM), and a random access memory (RAM). The CPU uses the RAM as a work area and controls each and the whole of the components mentioned above according to a computer program stored in the ROM. The RAM stores therein also various kinds of data used by the CPU during processing.

The image inputting unit 102 receives image data for forming an image through the scanner 5 or a network. The image data input from the scanner 5 is subjected to image processing by the image processing unit 103 and then is stored in the storage unit 107 or directly subjected to optical writing by the exposing unit 15. When image data subjected to image processing, such as a facsimile signal, is input, the image data is stored in the storage unit 107 or subjected to optical writing by the exposing unit 15 without image processing by the image processing unit 103.

The image forming unit 2 performs optical writing and develops, with toner, the photosensitive element 11 on which a latent image is formed as described above to form a toner image to be transferred. The toner image is transferred onto the paper sheet 6 conveyed from the paper feeding unit 3 and is fixed by the fixing unit 17. The paper sheet 6 is then discharged.

The operation displaying unit 104 includes, besides a key input device, an input device with a touch panel. The operation displaying unit 104 performs, with a liquid crystal display behind the touch panel, various display including display of an input setting condition and alarm display when the setting condition is not satisfied.

A contact-type or contactless IC tag as an example of an identification information storage unit is attached to, for example, an employee ID card possessed by a user of the image forming apparatus of the present embodiment. When the contact-type or contactless IC tag enters a radio communicable area, the personal authentication information detecting unit 105 as an example of an identification information acquiring unit performs radio communication with this IC tag. The IC tag employs a system called radio frequency identification (RFID) and has a known structure with an integrated antenna for transmission and reception, an integrated control IC, and other integrated components. Radio communication is performed between the IC tag and the personal authentication information detecting unit 105 serving as a reader/writer of the IC tag. The personal authentication information detecting unit 105 may be provided at the operation displaying unit 104.

The personal authentication information detecting unit 105 reads the user ID (an example of identification information to identify the user) stored in the IC tag through radio communication and transmits it to the control unit 101. The control unit 101 performs user authentication based on whether the user ID is included (is registered in advance) in user information 131 to be described later. Only an authenticated user can use the image forming apparatus of the present embodiment.

The sensor unit 106 includes various kinds of sensors such as a sensor detecting the conveyance condition (jam) of the paper sheet 6, a sensor detecting the density of the toner image on the photosensitive element 11, and a thermal sensor detecting the temperature of the fixing unit 17, and transmits the detected information to the control unit 101.

The storage unit 107 includes a hard disk drive (HDD) 121 and a non-volatile memory 122 such as a flash memory. The HDD 121 stores therein image data input from the image inputting unit 102 and processed by the image processing unit 103. The HDD 121 stores (registers) therein a name, a department, the user ID described above, or other information, as the user information 131 for the image forming apparatus of the present embodiment. The HDD 121 also stores therein usage history information 132 for each user. The non-volatile memory 122 or an external device (not shown) such as a server on a network may store therein the user information 131 and the usage history information 132.

The usage history information 132 associates applications (a copy application, a scanner application, a print application, and a fax application) used by each user within a given period of time in the past and the setting information of the applications with time information. For output applications (a copy application, a print application, and reception of a fax application), the setting information of the applications includes output setting information indicating the contents of items of output setting, for example, a paper type (plain paper, a cardboard, etc.), a paper size (B5, A4, B4, etc.), and a color mode (four colors, monochrome, etc.). The time information indicates user's operation time during application usage, that is, time from when various types of settings are started until the settings are completed and the operation start instruction of the application is executed (the copy button is pressed, for example) at the operation displaying unit 104. When the image forming apparatus of the present embodiment has information indicating each of the paper feeding cassettes 4*a* to 4*d* of the paper feeding unit 3 and includes peripheral devices (post-processing devices such as a stapler and a punch, for example), the usage history information 132 also includes the configurations and usage situations of the peripheral devices.

The following describes the reason why the configurations and usage situation histories of the peripheral devices (post-processing devices) are stored. In the operation of the peripheral devices, power for operation is supplied to the peripheral devices through the image forming apparatus. The maximum input power of the image forming apparatus is limited. The operation of the peripheral devices thus reduces the maximum power available in the image forming apparatus, leading to a shortage of the output power of the power source 108 for a heater. This shortage causes decrease in the temperature of the fixing unit 17. For this reason, when the use of the peripheral devices is forecasted, storage of heat is increased during warming up and the fixing temperature is thus set higher than when post-processing operation is absence.

The non-volatile memory 122 stores therein a table 133 for setting fixing temperature/warm-up duration that indicates the correspondence relation between the output setting and the fixing temperature of the fixing unit 17 and the correspondence relation between the fixing temperature and the warm-up duration in the image forming apparatus of the present embodiment. The items of the output setting and the contents of the items of the output setting include "color mode: four colors/monochrome/etc.", "paper type: plain paper/a cardboard/etc.", "paper size: B5/A4/B4/etc.", "the number of sheets", and "the presence or absence of post-process".

The control unit 101 includes a usage forecasting unit 111, a fixing temperature setting unit 112, a warm-up duration setting unit 113, and a warm-up start timing calculating unit 114. These are functional blocks associated with a process executed by the CPU in the control unit 101, using the user ID detected by the personal authentication information detecting unit 105, the usage history information 132 for each user, and the table 133 for setting fixing temperature/warm-up duration. For example, the CPU reads a computer program from the ROM into the RAM and executes it to implement these units on the computer.

The usage forecasting unit 111 as an example of a usage history information acquiring unit and an output setting forecasting unit reads the usage history information 132 for the user specified by the user ID detected by the personal authentication information detecting unit 105. The usage forecasting unit 111 then forecasts an application and the setting of the application (the output setting for an output application) to be used by the user.

When the forecasted application is an output application, the fixing temperature setting unit 112 as an example of a fixing temperature setting unit reads the fixing temperature associated with the output setting from the table 133 for setting fixing temperature/warm-up duration. The readout fixing temperature is set as the fixing temperature of the fixing unit 17 in the RAM in the control unit 101.

The warm-up duration setting unit 113 as an example of a start timing setting unit reads duration from which warming up of the fixing unit 17 is started until which the temperature reaches the fixing temperature set by the fixing temperature setting unit 112, from the table 133 for setting fixing temperature/warm-up duration. The readout duration is set in the RAM in the control unit 101.

When the output setting of the output application forecasted by the usage forecasting unit 111 is input by the user through the operation displaying unit 104, the warm-up start timing calculating unit 114 as an example of a start timing setting unit forecasts timing of execution of the operation start instruction (pressing of the copy button, for example). The warm-up start timing calculating unit 114 then calculates a time to start warming up of the fixing unit 17 so that the temperature of the fixing unit 17 reaches the fixing temperature at the forecasted time. In other words, the warm-up start timing calculating unit 114 calculates a time ahead of (earlier than) the forecasted time by the warm-up duration.

The control unit 101 starts warming up at the time calculated by the warm-up start timing calculating unit 114. The control unit 101 starts warming up immediately when the time calculated by the warm-up start timing calculating unit 114 has already been passed. In the warming up, while a heater (not shown) provided at the fixing unit 17 is fed with power from the power source 108 for a heater to heat a fixing roller (not shown), the control unit 101 performs feedback control on the basis of the temperature detected by a thermal sensor arranged near the fixing roller.

Operation of Image Forming Apparatus

Figure 3:
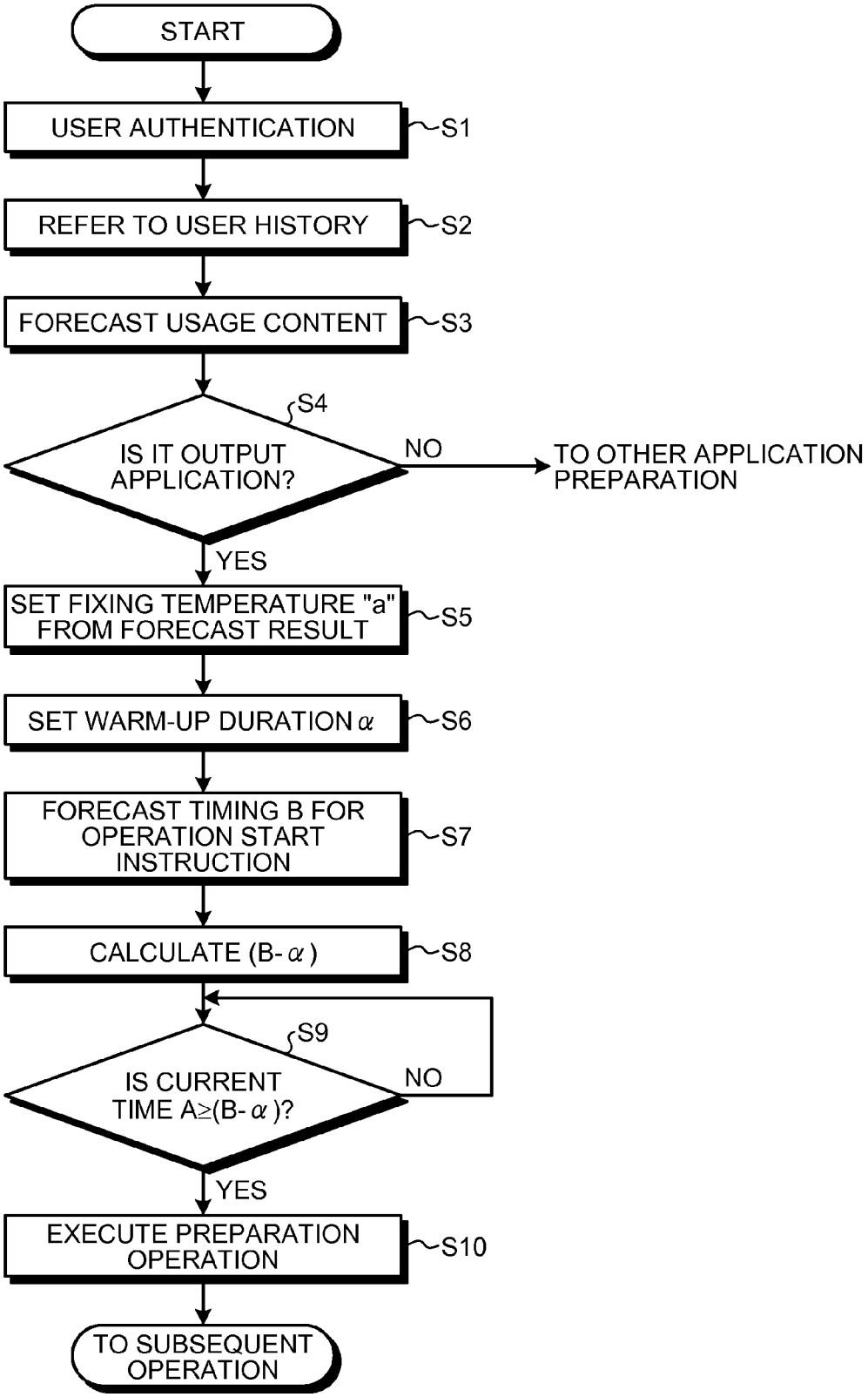
FIG. 3 is a flowchart illustrating a process performed by a control unit when a user approaches the image forming apparatus of the present embodiment.

FIG. 3 is a flowchart illustrating a process (method for setting a fixing temperature) performed by the control unit 101 when a user approaches the image forming apparatus of the present embodiment.

When a user holding an IC tag (a contactless IC tag in this case) enters a radio communicable area where the IC tag and the personal authentication information detecting unit 105 can perform radio communication, user authentication is performed (step S1: an identification information acquiring process and a user authentication process). More precisely, the personal authentication information detecting unit 105 acquires a user ID stored in the IC tag through radio communication with the IC tag and transmits it to the control unit 101. The control unit 101 examines whether the user information stored in the HDD 121 includes the acquired user ID, that is, whether the user ID is already registered. As a result, if the user ID is registered, the process goes to step S2. If the user ID is not registered, the operation displaying unit 104 displays the fact accordingly (not shown in FIG. 3).

At step S2, the usage forecasting unit 111 reads and refers to the usage history information 132 for the user specified by the user ID authenticated at step S1 (a usage history information acquiring process). The usage forecasting unit 111 then forecasts an application and the setting of the application to be used by the specified user from the usage history information referred to (step S3: an application forecasting process and an output setting forecasting process when the forecasted application is an output application). In the forecast of an application and the setting of the application, the application with the highest usage frequency by the user, during the same time period (morning/afternoon, every three hours, or other periods) on the same day of the week in a certain period of time in the past, for example, and the setting of this application are selected (forecasted).

The control unit 101 determines whether the forecasted application is an output application (step S4). If the application is not determined to be an output application (No at step S4), the process shifts to the preparation operation of the corresponding application in accordance with another flow not shown in FIG. 3. In contrast, if the application is determined to be an output application (Yes at step S4), the fixing temperature setting unit 112 sets a fixing temperature "a" on the basis of the setting (a paper type, a paper size, a color mode, the number of sheets, etc.) forecasted at step S3 (step S5: a fixing temperature setting process).

In the present embodiment, the fixing temperature setting unit 112 acquires by reading a fixing temperature associated with the forecasted setting from the table 133 for setting fixing temperature/warm-up duration to set it as the fixing temperature "a". FIG. 4 is a diagram illustrating an example of the relation between the forecasted output setting and the fixing temperature "a" and the relation between the fixing temperature "a" and a warm-up duration $\alpha$ to be described later. In other words, FIG. 4 illustrates an example of the content of the table 133 for setting fixing temperature/warm-up duration.

FIG. 4 indicates the following matters, for example. The fixing temperature is set at 155° C. with the forecast result of "1" (paper type: plain paper, paper size: A4, color: four colors, the number of sheets: 1 to 5 sheets, post-process: yes). The fixing temperature is set at 170° C. with the forecast result of "2" (paper type: plain paper, paper size: A4, color: four colors, the number of sheets: 6 to 12 sheets, post-process: yes). The fixing temperature is set at 180° C. with the forecast result of "3" (paper type: plain paper, paper size: A4, color: four colors, the number of sheets: 13 to 50 sheets, post-process: yes).

The warm-up duration setting unit 113 sets the warm-up duration $\alpha$ (step S6). More precisely, the warm-up duration setting unit 113 reads the warm-up duration associated with the fixing temperature "a" from the table 133 for setting fixing temperature/warm-up duration and set it in the RAM in the control unit 101. As illustrated in FIG. 4, for the fixing temperature at 155° C., 177° C., or 180° C., the warm-up duration $\alpha$ is set to 6 seconds, 8 seconds, or 9.5 seconds, respectively.

The warm-up start timing calculating unit 114 forecasts a time (timing) B at which the user sets the output application forecasted at step S3 through the operation displaying unit 104 and executes an operation start instruction (presses the copy button, for example) (step S7). The warm-up start timing calculating unit 114 then calculates a time ($B-\alpha$) that is earlier than the time B by the warm-up duration $\alpha$ (step S8). At step S7, a predetermined fixed duration is employed for the duration during which the user walks from the position (near the outer edge of the radio communicable area) where step S1 is executed to the front of the image forming apparatus.

The control unit 101 determines whether a current time A is on or after the time ($B-\alpha$) (step 9). If the current time a is determined to be on or after the time ($B-\alpha$) (Yes at step S9), the control unit 101 executes a preparation operation including the start of warming up of the fixing unit 17 (step S10) and then performs the subsequent operation (maintaining the standby state or other operations). Examples of the preparation operation other than the warming up of the fixing unit 17 include light amount adjustment of the exposing unit 15 and the rotation control of the photosensitive element 11.

Transition of Operations by User and Apparatus

Figure 5:
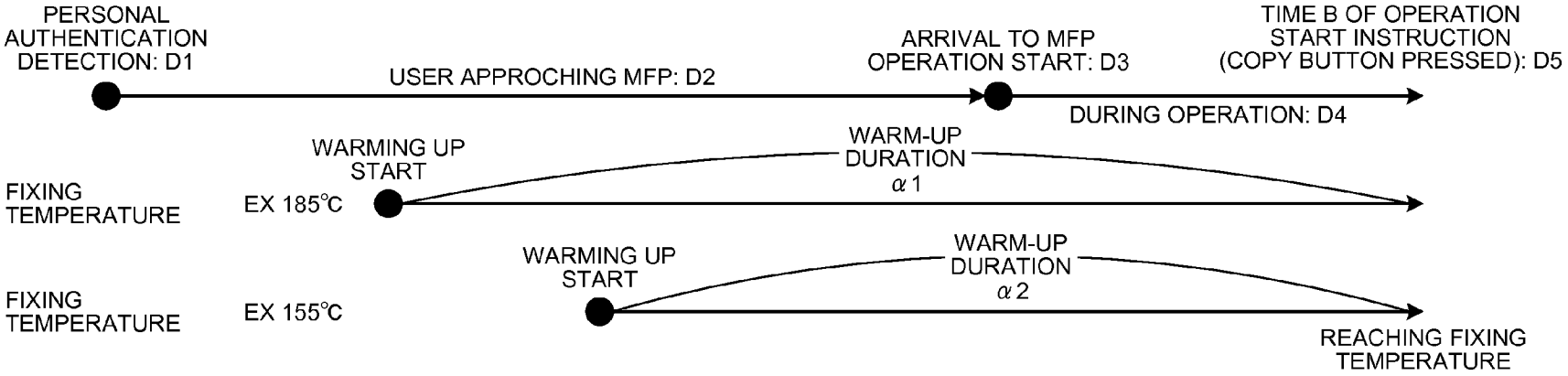
FIG. 5 is a schematic illustrating transition of operations by a user and the image forming apparatus of the present embodiment when the user uses the image forming apparatus.

FIG. 5 is a schematic illustrating transition of operations by a user and the image forming apparatus of the present embodiment when the user uses the image forming apparatus. The operation of the image forming apparatus is supplementally described with reference to FIG. 5.

First, when a user approaches the MFP to reach a predetermined distance from the MFP, personal authentication is performed (operation: D1). The user keeps approaching the MFP (operation: D2). When the user reaches the MFP, operation starts (operation: D3).

After the personal authentication, the MFP sets the fixing temperature, sets the warm-up duration, and calculates warm-up start timing, and starts warming up on the calculated timing. When the fixing temperature is 185° C. and the warm-up duration is $\alpha 1$, the MFP starts warming up at a time that is earlier than the time B for the operation start instruction by $\alpha 1$. When the fixing temperature is 155° C. and the warm-up duration is $\alpha 2$, the MFP starts warming up at a time that is earlier than the time B for the operation start instruction by $\alpha 2$.

In such a manner, warming up is started according to the time B for the operation start instruction. This saves the user from waiting and eliminates unnecessary power for maintaining, in the standby state, the temperature having reached the fixing temperature at an early stage.

The present invention allows the following modifications (1) to (8) to the embodiment described above.

(1) The fixing temperature "a" may be calculated using a calculation formula instead of being acquired from the table.

(2) To forecast the timing B for executing the operation start instruction (step S7 in FIG. 4), a predetermined fixed value may be used as the time (operation duration) during which the user operates the operation displaying unit 104 to perform setting.

(3) To forecast the timing B of executing the operation start instruction (step S7 in FIG. 4), the walking speed of the user registered as the user information 131 in advance may be used to forecast the duration during which the user walks from the position (near the outer edge of the radio communicable area) where step S1 is executed to the front of the image forming apparatus.

(4) In the forecast of the operation duration on the operation displaying unit 104, when an operation screen, in which display contents are changed so that the user needs not perform setting one by one, is already displayed, the operation duration may be set to be shorter than that forecasted from the usage history in the past.

(5) When the fixing temperature needs to increase because the output setting by the user is different from the forecast, either of the following processes "a" and "b" may be performed.

a: The operation displaying unit 104 displays "Please wait" or other sentences until the completion of the fixing temperature increase, and displays "Copying is available" or other sentences at the time of the completion.

b: When the fixing temperature increase is needed because the number of sheets set by the user is larger than the forecasted number of sheets, the forecasted number of sheets is printed without fixing temperature increase, and the remaining number of sheets is printed at the time of the completion of the fixing temperature increase. In other words, the operation of the output application is suspended to increase the fixing temperature and is started again at the time of the completion of the increase.

(6) When the IC tag possessed by the user employs a contact type, the operation: D1 and the operation: D3 in FIG. 5 may be executed almost on the same timing.

(7) The items of the output setting include at least one of the number of sheets, among the number of sheets, a paper size, a paper type, a color mode, and the presence or absence of post-process.

(8) A user ID stored in the memory in a mobile terminal device possessed by a user may be acquired from the mobile terminal device through short distance radio communication utilizing an electric wave, a sound wave in a non-audible frequency band, or the like.

The embodiment provides an effect of enabling reduction in unnecessary power consumption due to the setting of high fixing temperature.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an identification information acquiring unit that acquires identification information to identify a user;

a usage history information acquiring unit that acquires usage history information for the user specified by the identification information;

an output setting forecasting unit that forecasts output setting for image forming used by the user based on the usage history information; and a fixing temperature setting unit that varies based on the identified user, and sets a fixing temperature based on the forecasted output setting.

2. The image forming apparatus according to claim 1, further comprising:

a start timing setting unit that sets timing to start warming up of a fixing unit according to the fixing temperature set by the fixing temperature setting unit.

3. The image forming apparatus according to claim 1, wherein the output setting includes at least number of sheets.

4. The image forming apparatus according to claim 1, further comprising:

an operation displaying unit that changes a display content according to the forecasted output setting.

5. The image forming apparatus according to claim 1, wherein the identification information is stored in a contactless integrated circuit (IC) tag possessed by the user, and the identification information acquiring unit acquires the identification information through radio communication from the IC tag.

6. A method of setting a fixing temperature of an image forming apparatus, the method comprising:

acquiring identification information to identify a user;

acquiring usage history information for the user specified by the identification information;

forecasting output setting for image forming used by the user based on the usage history information; and varying a fixing temperature based on the identified user, and setting the fixing temperature based on the forecasted output setting.

7. A computer program product comprising a non-transitory computer-usable medium having computer-readable program codes embodied in the medium, wherein the program codes when executed cause a computer to execute:

acquiring identification information to identify a user;

acquiring usage history information for the user specified by the identification information;

forecasting output setting for image forming used by the user based on the usage history information; and varying a fixing temperature based on the identified user, and setting the fixing temperature based on the output forecasted setting.

* * * * *